United States Patent [19]

Voegel

[11] Patent Number: 4,540,474

[45] Date of Patent: Sep. 10, 1985

[54] LIGHT LEVEL ELECTRODE SETTING GAUGE AND METHOD OF USE

[75] Inventor: Robert L. Voegel, Newburgh, Ind.

[73] Assignee: Aluminum Company of America, Pittsburgh, Pa.

[21] Appl. No.: 617,078

[22] Filed: Jun. 4, 1984

[51] Int. Cl.[3] ..... C25C 3/00; C25C 3/06

[52] U.S. Cl. ..... 204/67; 204/225; 204/243 R

[58] Field of Search ..... 204/67, 225, 243 R

[56] References Cited

U.S. PATENT DOCUMENTS

| | | | |
|---|---|---|---|
| 3,480,526 | 11/1969 | Duclaux | 204/67 |
| 4,221,641 | 9/1980 | Weber | 204/67 |
| 4,465,578 | 8/1984 | Duclaux et al. | 204/245 |

*Primary Examiner*—Howard S. Williams

*Attorney, Agent, or Firm*—Elroy Strickland

[57] ABSTRACT

A method of adjusting the position of objects in relation to a datum plane, the method including the step of providing a mark on the objects at a known distance from the surface of the objects that will be positioned in predetermined relationship with the datum plane. One of the objects is next placed in the predetermined relationship with the plane, the object being moved from an original position relative to the plane after a predetermined period of time. A second object is then placed in the predetermined relationship with the plane, and a beam of light is directed to the second object, the beam providing a light image on the object. The second object is now moved until the image of the light coincides with the mark provided on the object.

5 Claims, 2 Drawing Figures

LIGHT LEVEL ELECTRODE SETTING GAUGE AND METHOD OF USE

BACKGROUND OF THE INVENTION

Figure 1:
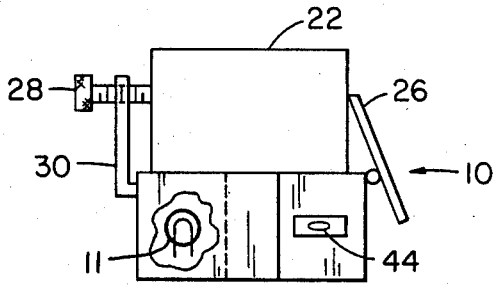

The invention relates generally to a method and apparatus for setting the position of objects relative to a datum plane, the method and apparatus finding particular utility in setting anodes in an electrolytic cell, though the invention is not limited thereto.

In processes that involve the consumption of elements, the elements are usually inserted or installed in apparatus of the process in a manner that provides a uniform setting of the elements. Without such uniform setting, the process functions inefficiently if it functions at all. An example of this is the setting of carbon anodes in a Hall reduction cell relative to a molten aluminum pad located in the lower cathode bottom of the cell. The carbon material of the anodes burns off at a substantially uniform rate, but the anodes in any given cell are not placed in the cell at the same time. As the anodes burn off, they are lowered toward the aluminum pad to maintain a proper predetermined distance between the bottom surface of the anode and the datum plane of the pad. At the completion of the burn off process, a new, full size anode is put into place in place of the burned off anode, the new anode often being placed beside an anode that is partially consumed. In the process of locating the new full size anode in the cell, the anode is lowered in the cell by a supporting rod until the bottom surface of the anode is located above the metal pad in the same horizontal plane as the bottom surfaces of the other anodes in the cell including partially consumed anodes.

Heretofore, anode setting has been based largely on the horizontal position of bridge structures that support the anodes in the cell, the bridge structures being located over the cell and extending along the length of the cell. Because of the heat rising from the cell and the weight of the anodes suspended from the bridge, the bridge can sag as much as $1\frac{1}{4}$ inches adjacent the center portion thereof such that the bridge is not itself a good horizontal reference for setting anodes.

What is needed in the industry is a method and means that can provide a horizontal reference independent of supporting bridge structures such that a consistently reliable reproducible reference is available for anode setting. In addition, the means should be simple and inexpensive to use.

BRIEF SUMMARY OF THE INVENTION

The present invention employs a method in which the supporting rod of a new anode is provided with a simple straight line mark across the width of the rod at a location that is a predetermined distance from the bottom surface of the anode, the anode being attached to the lower end of the rod before the mark on the rod is made. When the time arrives for the installation of the newly assembled rod and anode, the assembly is positioned in the cell and clamped in the circuit of the cell adjacent an earlier and now partially consumed anode having the same mark on its supporting rod. However, at this time the earlier rod and anode have been moved downwardly into the cell such that the mark on the old assembly is vertically lower than the position it occupied when the assembly was newly installed.

A hand held device capable of providing a narrow beam of light is now clamped to the old rod adjacent the mark thereon. The beam of light provided by the device is directed horizontally toward the new rod to provide a light image on the new rod in the form of a narrow line. The location of the narrow line of light is vertically displaced above the mark on the old rod a distance that is equal to the amount of the consumption of the old anode. The new rod is now vertically moved to align the mark thereon with the narrow line of light shining on the new rod. This locates the bottom surface of the new anode in line with the bottom surface of the old, partially consumed anode.

The device providing the light beam and line image is provided with a bubble level, similar to a carpenter's level, and an adjustment screw or bolt that rotates the device about a horizontal axis to insure that a truly horizontal beam of light is directed to the new rod.

It can be appreciated that such a hand held device is independent of any vertical movement of supporting bridges, is inexpensive to make and quickly and easily attached to an anode rod. In this latter regard, the device is provided with a simple spring-loaded clamp that allows personnel to simply place the device on the rod and release the clamp.

THE DRAWING

Figure 2:
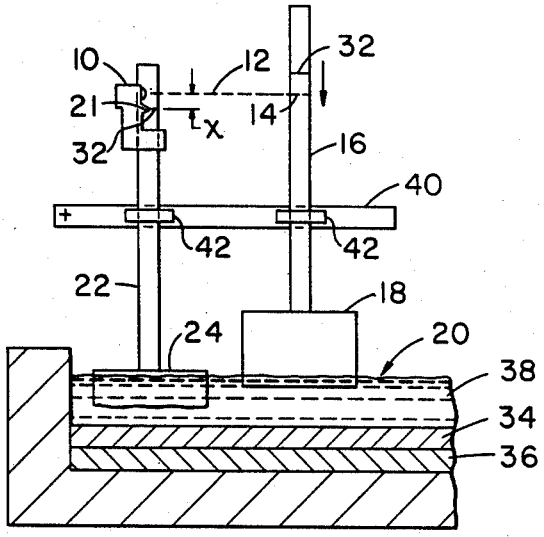

The invention, along with its advantages and objectives, will be best understood from consideration of the following detailed description and the accompanying drawing in which:

FIG. 1 is a plan view of a hand held device for setting electrodes in the manner of the subject invention, and FIG. 2 is a partial view of an electrolytic cell showing two electrode assemblies thereof marked in accordance with the invention.

PREFERRED EMBODIMENT

Referring now to the drawing, FIG. 1 thereof shows a hand held device 10 containing a light source 11 capable of producing a narrow beam of light 12, as shown schematically in FIG. 2 of the drawing. More particularly, the beam of light provides a light image in the form of a relatively narrow horizontal line 14 (FIG. 2) on a surface when the beam is directed to the surface. The surface in FIG. 2 is that provided by a rod 16 that supports an anode 18 in an electrolytic cell 20.

Device 10 can be any hand held means capable of providing the light image 14. In the figure of the drawing it is a small box or housing capable of being gripped by one hand of a person, the box containing a light bulb (11) and batteries for powering the bulb. In front of the bulb, i.e., in a direction facing rod 16, are located lens means (not shown) that focus the light of the bulb to create the beam of light 12. For purposes explained hereinafter, device 10 is provided with a pointer 21. The pointer is vertically spaced from light beam 12 by distance "x" (FIG. 2) for reasons explained hereinafter.

In both figures of the drawing, device 10 is shown mounted on a rod 22; in FIG. 2 rod 22 supports a first anode 24 in cell 20. Device 10 is easily and quickly mounted on a rod by virtue of a spring-loaded clamp arm 26, 26 being suitably attached to one side of the housing and opposite a thumbscrew 28 and extension 30 located on the other side of the housing. To locate the housing and light source on an anode rod, a person simply grips the housing and clamp arm in one hand, rotates the clamp arm in an outwardly direction to provide a space between thumbscrew 28 and the clamp arm sufficient to accommodate the rod. The housing is then placed against the rod and the clamp arm released against the rod.

The method of the invention involves placing a mark 32 across the rod of a new anode after the rod and anode are assembled together. The mark is placed on the rod of every new rod-anode assembly such that every assembly, when placed in a cell, will have such a mark. Each mark is located on each rod at the same predetermined distance from the bottom surface of each anode. A crayon or felt tip marker can be used to mark the rods of the new assemblies when the assemblies are made, i.e., when the rods are secured to new anodes. This involves measuring the distance from the bottom surface of the anode of the new assembly to a location near the upper end of the associated rod, the distance being that which will locate the mark in a position suitable for viewing by personnel that set the anodes in an electrolytic cell.

In the process of making metal in a Hall cell, for example, the metal forms a molten metal pad on the surface of a cathode liner located in the bottom of the cell, such as shown in section in FIG. 2; the metal pad is labeled 34 in FIG. 2 while the liner is labeled 36. The electrolyte of the cell is designated by numeral 38. In the metal making process, the carbon of the anode is consumed or burned away such that after a period of time, the rod and remaining portion of the anode are removed from the cell, and a new rod-anode assembly is inserted in place thereof. During the process of making metal, however, all of the assemblies are lowered in the cell by a bridge 40 (FIG. 2) to maintain a proper anode-cathode distance, the proper distance being that which makes the most metal with the least amount of current flow through the cell. Hence, it is important, i.e., necessary, for efficient cell operation that the bottom surface of every anode in the cell be placed and maintained at the optimum distance from the datum plane pad 34. And, for purposes of further economy, it is desirable that the setting of the anodes be as easy and rapid as possible. This is effected by the use of marks 32 provided on the rods of the anode-rod assemblies in the manner described above and the light source, 11 described above.

More particularly, when a new anode-rod assembly is inserted in a cell, such as assembly 16, 18 in FIG. 2, the rod 16 thereof is first secured to a horizontal support or bridge structure 40 by a suitable clamping device 42. Device 10 is then placed on the rod of the older assembly 22, 24, the older assembly having been secured to support structure 40 in the same manner as the new assembly. The light source of 10 is oriented toward rod 16 and positioned at a location on rod 22 that locates pointer 21 at the location of mark 32 on 22. This places the beam 12 provided by the light source at a vertical distance "x" (FIG. 2) from the mark on rod 22; distance x is the distance that the bottom portion of anode 24 has been consumed at the time the new assembly is placed in the cell. The space or distance between pointer 21 and light beam 12 then is the distance that older anode 24 has burned off.

As explained earlier, light beam 12 provides a light image on the rod of new assembly 16, 18 at location 14 in the form of a narrow horizontal line of light. Light image is located on new rod 16 at the vertical distance "x" above the mark 32 on old rod 22. The person employed to set the new assembly now releases clamp 42 and orders the lowering of the assembly, if mark 32 on rod 16 is located above light image 14, toward metal pad 34 in cell 20 until the mark 32 on rod 16 occupies the location of light image 14. If mark 32 is below light image 14, the assembly is raised until the mark and image coincide. When the mark and light image coincide, the bottom surface of new anode 18 lies in the same plane as the bottom surface of the older anode 24. The person setting the assembly now clamps the rod of the assembly in place at 42 on support structure 40. 42, in addition, electrically connects the rod and anode in the circuit of cell 20.

To insure that the light beam 12 is truly horizontal (such that the bottom surface of the new anode will lie in the same horizontal plane as that of the old anode), the housing of 10 is provided with a level bubble 44, as used in carpenter's levels, and the thumbscrew 28 described above. More particularly, the level bubble is located on a horizontal planar surface of the housing of 10 such that when the housing is attached to an anode rod, thumbscrew 28 is simply rotated to translate the shank of the screw in relation to the rod and against the force of the spring (not shown) of clamp arm 26. This rotates the housing and light source about a horizontal axis extending into the face of the rod; the operator simply centers the bubble of level 44 in its glass container to determine when the beam 12 from the light source will be level, i.e., horizontal; with the light source level, the new anode-rod assembly is ready to be set at the proper distance from metal pad 34 by aligning light line 14 with mark 32.

As the new anode 18 is consumed in the metal making process of cell 20, it too can be used to set a new anode-rod assembly (not shown) in the cell. When the new assembly is placed in the cell, device 10 is removed from rod 22, placed on rod 16 and leveled in the manner described above.

While the invention has been described in terms of preferred embodiments, the claims appended hereto are intended to encompass all embodiments which fall within the spirit of the invention.

What is claimed is:

1. A method of setting anodes in an electrolytic cell, comprising the steps of:

providing a mark on rods that support respective anodes in an electrolytic cell after each of the rods and anodes are newly assembled together, the location of the marks being equidistant from the bottom surface of each of the anodes, placing a first anode and rod of the newly assembled anodes and rods in the circuit of the cell such that a portion of the anode is consumed in the cell over a period of time, lowering the anode and rod in the cell a distance equal to the portion of the anode consumed, placing a second newly assembled anode and rod in the cell, placing a light source on the rod of the first anode adjacent the mark provided thereon, directing a beam of light horizontally from the source to the rod of the second anode in a manner that provides a narrow light image on said rod and at a location thereon that is vertically displaced above the mark on the first rod by a distance equal to the amount of anode consumption, and adjusting the vertical position of the second rod and anode such that the mark provided on the second rod is located at the vertical position of the light image on the rod.

2. The method of claim 1 including the step of adjusting the level of the light source to provide a truly horizontal beam of light.

3. A device for setting the vertical position of electrodes in an electrolytic cell, the device comprising:

a housing, a source of light located in said housing, said source providing a narrow beam of light and a narrow image of the beam when the beam reaches a solid surface, means for clamping the housing to a structure supporting an electrode and for releasing the housing from said structure, and means for leveling the housing and light source in relation to the structure.

4. The device of claim 3 in which the means for clamping and releasing the housing comprises a spring-biased clamp arm for engaging the electrode supporting structure between the arm and the housing when the arm is released against the supporting structure.

5. The device of claim 3 in which the means for leveling the housing and light source includes a level bubble located on the housing.

* * * * *